US006212917B1

(12) United States Patent
Rathbun

(10) Patent No.: US 6,212,917 B1
(45) Date of Patent: Apr. 10, 2001

(54) QUICK-RELEASE LOCK ASSEMBLY WITH COMPRESSION/EXPANSION CAPABILITY

(75) Inventor: Roderick E. Rathbun, Washington, NC (US)

(73) Assignee: R-Tex LLC, Greenville, NC (US)

( * ) Notice: Subject to any disclaimer, the term of this patent is extended or adjusted under 35 U.S.C. 154(b) by 0 days.

(21) Appl. No.: 09/333,857

(22) Filed: Jun. 15, 1999

(51) Int. Cl.[7] ..... D06B 23/00
(52) U.S. Cl. ..... 68/212; 242/597.4; 411/433
(58) Field of Search ..... 68/212, 189, 198; 242/597.4; 411/433, 432, 437, 544

(56) References Cited

U.S. PATENT DOCUMENTS 2,736,227 2/1956 Stroble .
3,777,516 * 12/1973 Tigges ..... 68/198
5,230,596 7/1993 Morad ..... 411/433
5,477,709 12/1995 Rowe ..... 68/212
5,813,254 * 9/1998 Yang ..... 68/212

FOREIGN PATENT DOCUMENTS 1270240 12/1970 (GB) ..... 411/433

* cited by examiner

*Primary Examiner*—Philip R. Coe
(74) *Attorney, Agent, or Firm*—Steven J. Hultquist; Marianne Fuierer

(57) ABSTRACT

A yarn roll spindle locking assembly including a pivotally translating engagement/release mechanism. The locking assembly may be dropped onto a spindle to self-actuatingly lock in position and is readily removable from the spindle by manual depression of a release element. The locking assembly includes upper and lower body members coupled to one another so that the upper main body member and lower main body member are resiliantly biased apart from one another to provide the locking assembly with compression/expansion capability.

22 Claims, 2 Drawing Sheets

QUICK-RELEASE LOCK ASSEMBLY WITH COMPRESSION/EXPANSION CAPABILITY

BACKGROUND OF THE INVENTION

1. Field of the Invention

This invention relates generally to a mechanical lock assembly of simple and manually operable character.

2. Description of the Related Art

Numerous applications exist for mechanical locks having a quick-connect, quick-release character. In such applications, it is highly desirable, from the standpoint of ease of fabrication and use, to minimize the number of moving parts. Such minimization permits the lock assembly to be simply and efficiently manufactured, as well as rendering it highly reliable, since a minimum number of moving parts decreases wear and increases service life of the lock assembly since failure modes for the device are correspondingly reduced, in relation to more complex locks and structurally intricate locks having a large number of moving parts.

In the textile industry, locking assemblies are employed to secure yarn rolls (typically called "packages" in the industry) on perforate spindles through which dye under high pressure is flowed into the yarn roll for dying of the yarn prior to its further processing. For this purpose, the perforate spindle is provided at its extremity with a threaded end rod on which is secured a lock assembly. Due to shrinkage of the yarn rolls as a result of chemical impregnation and differential temperature effects during the dying operation, simple nut locking members are impractical, since they become loosened in use, and the high pressure of the dye medium is lost as a concomitant of the resulting leakage.

Accordingly, the textile industry has adopted various types of locking assemblies which are adapted to mate with and grippingly engage the threads of the end rod. These conventional locking assemblies for dye spindle usage include various designs in which the assembly contains threaded surface cam members which exert a ratcheting engagement with the threads of the end rod when slid downwardly over the rod into abutting engagement with the outer extremity (shoulder) of the yarn roll.

A major problem which has been experienced in the use of such locking assemblies is that they tend to lock or seize in position on the threaded end rod due to the high pressure on the locking assembly exerted in the distal direction of the rod, so that the locking assembly is extremely difficult to disengage when the dying step is completed. This problem is worsened by the compression/expansion effects on the locking assembly by the yarn roll subsequent to the dying operation, particularly when a multiplicity of yarn rolls are vertically stacked on a same spindle. As a result, it is extremely difficult to "break lock" of the assembly and obtain release from the threads of the rod.

More generally, in the use of locks of all types, there is a desire to minimize the manual effort necessary to actuate the lock mechanism for locking and unlocking of the lock assembly. A very simple lock assembly with a minimal number of moving parts offers a number of advantages. First, the lock actuator/deactuator may be correspondingly simple in mechanical structure. Second, the low number of moving parts minimizes friction and inertial resistance in the operation of the lock to open and close it. Third, a minimal number of moving parts correspondingly minimizes the susceptibility of the lock assembly to environmental contaminants, e.g., airborne particulates, relative humidity, sand, soil, grit, etc., so that the locking assembly is less likely to bind or seize in use, than a locking assembly having a greater number of structural components. Fourth, the time required to actuate a lock assembly having a minimal number of parts is typically shorter than is the case with a lock assembly having a large number of coacting parts which must be sequentially or corporately engaged and motively operated.

Illustrative locking assemblies developed in recent years in the textile yarn dying industry include the locking assembly disclosed in U.S. Pat. No. 5,477,709 issued Dec. 26, 1995 to Gregory A. Rowe for "Locking Assembly for Securing and Sealing Spools to a Spindle During a Drying Operation" and the locking assembly described in U.S. Pat. No. 5,868,538 issued Feb. 9, 1999 to Roderick E. Rathbun for "Quick Release Lock Assembly." Although these respective locking assemblies represent chronologically successive improvements in the art, there is a continuing need for locking assemblies of a compact, readily manually manipulatable character, having a minimal number of moving parts, which are simple to manufacture, efficient to operate in a quick locking and quick releasing fashion, which are physically robust, and which are capable of being installed on and removed from the threaded rod of the spindle, with a minimum of manual effort.

Accordingly, it is an object of the present invention to provide an improved locking assembly meeting the foregoing criteria.

Other objects and advantages of the present invention will be more fully apparent from the ensuing disclosure and appended claims.

SUMMARY OF THE INVENTION

In a broad aspect, the present invention relates to a yarn roll spindle locking assembly including a pivotally translatable engagement/release mechanism.

In one aspect, the invention relates to a locking assembly useful for lockingly engaging a threaded rod, in which the locking assembly comprises:

- an upper main body member having a central bore therethrough, a cavity, and a transverse bore, the cavity communicating with and extending radially outward from said central bore, the cavity having a floor therein, and the transverse bore extending through the main body and communicating with said cavity above said floor;
- a biasing element disposed in said cavity and extending upwardly from the floor of said cavity;
- a pivot pin mounted in the transverse bore; and
- a jaw member supported by the pivot pin, the jaw member having an outer portion and an inner engagement face, the outer portion having a top surface and a bottom surface coupled with the biasing element, the engagement face having an upper threaded portion and a lower smooth portion;
- a lower main body member having a central bore therethrough;
- means for coupling the upper main body member and the lower main body member with one another so that the upper main body member and lower main body member are resiliantly biased apart from one another to provide the locking assembly with compression/expansion capability.

Another aspect of the invention relates to a yarn dyeing apparatus, comprising:

a yarn dyeing spindle assembly, including an upwardly extending threaded rod;

a locking assembly lockingly engaging said threaded rod, said assembly comprising:

an upper main body member having a central bore therethrough, a cavity, and a transverse bore, the cavity communicating with and extending radially outward from said central bore, the cavity having a floor therein, and the transverse bore extending through the main body and communicating with said cavity above said floor;

a biasing element disposed in said cavity and extending upwardly from the floor of said cavity;

a pivot pin mounted in the transverse bore; and a jaw member supported by the pivot pin, the jaw member having an outer portion and an inner engagement face, the outer portion having a top surface and a bottom surface coupled with the biasing element, the engagement face having an upper threaded portion and a lower smooth portion;

a lower main body member having a central bore therethrough;

means for coupling the upper main body member and the lower main body member with one another so that the upper main body member and lower main body member are resiliantly biased apart from one another to provide the locking assembly with compression/expansion capability;

wherein the threaded rod extends through the central bore in each of said upper main body member and said lower main body member, and the upper threaded portion of the engagement face of the jaw member is threadably engaged with threading on the threaded rod.

Still another aspect of the invention relates to a locking assembly comprising upper and lower body members coupled to one another so that the upper main body member and lower main body member are resiliantly biased apart from one another to provide the locking assembly with compression/expansion capability, with a central opening in each of the upper and lower body members, in registration with one another, and with a pivotable jaw member mounted on the upper body member biased to a locking position, and manually pivotable to a release position.

Other aspects, features and embodiments of the invention will be more fully apparent from the ensuing disclosure and appended claims.

DETAILED DESCRIPTION OF THE INVENTION, AND PREFERRED EMBODIMENTS THEREOF

Figure 1:
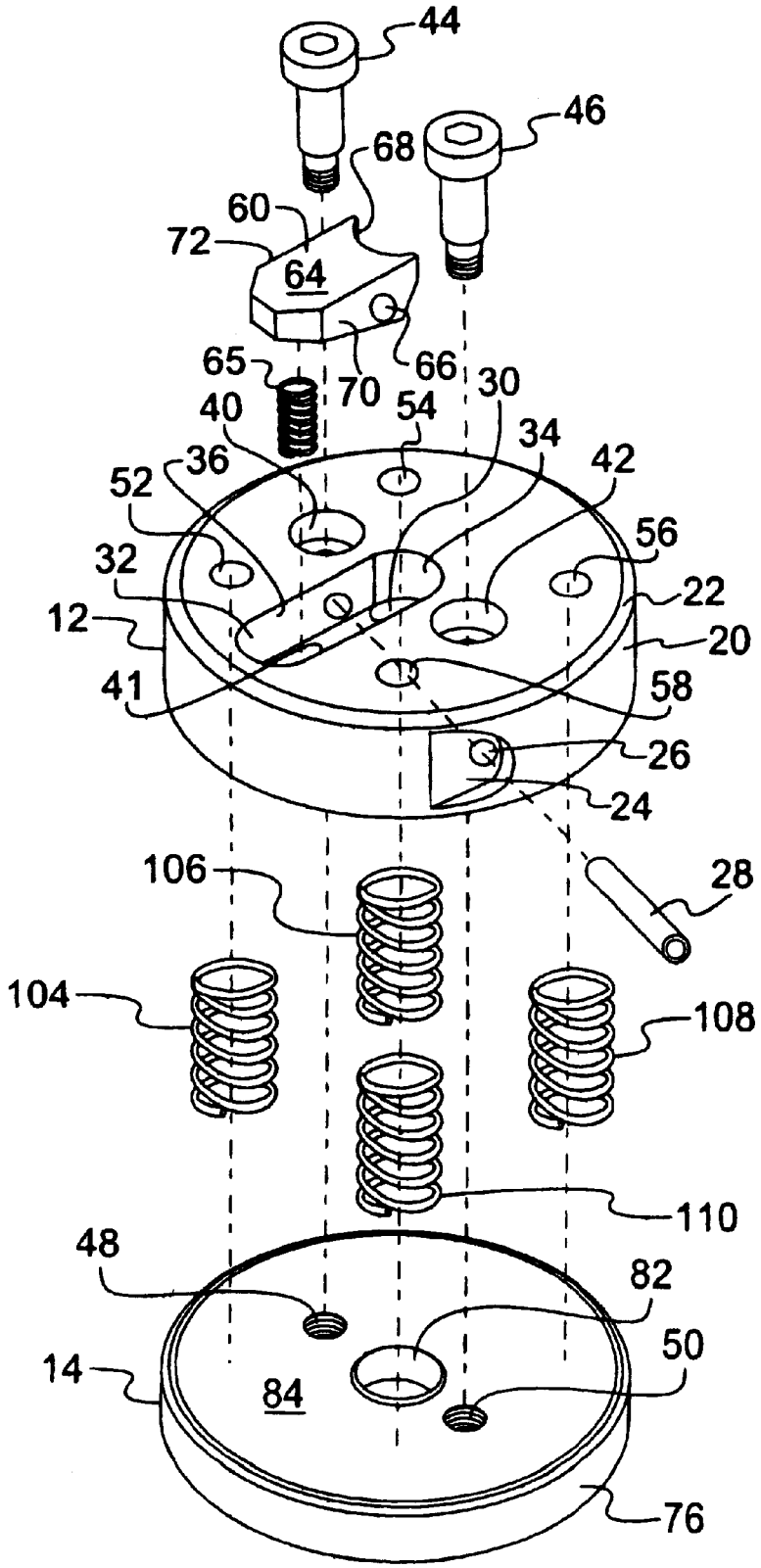
FIG. 1 is an exploded perspective view of a locking assembly according to one embodiment of the invention.
Figure 2:
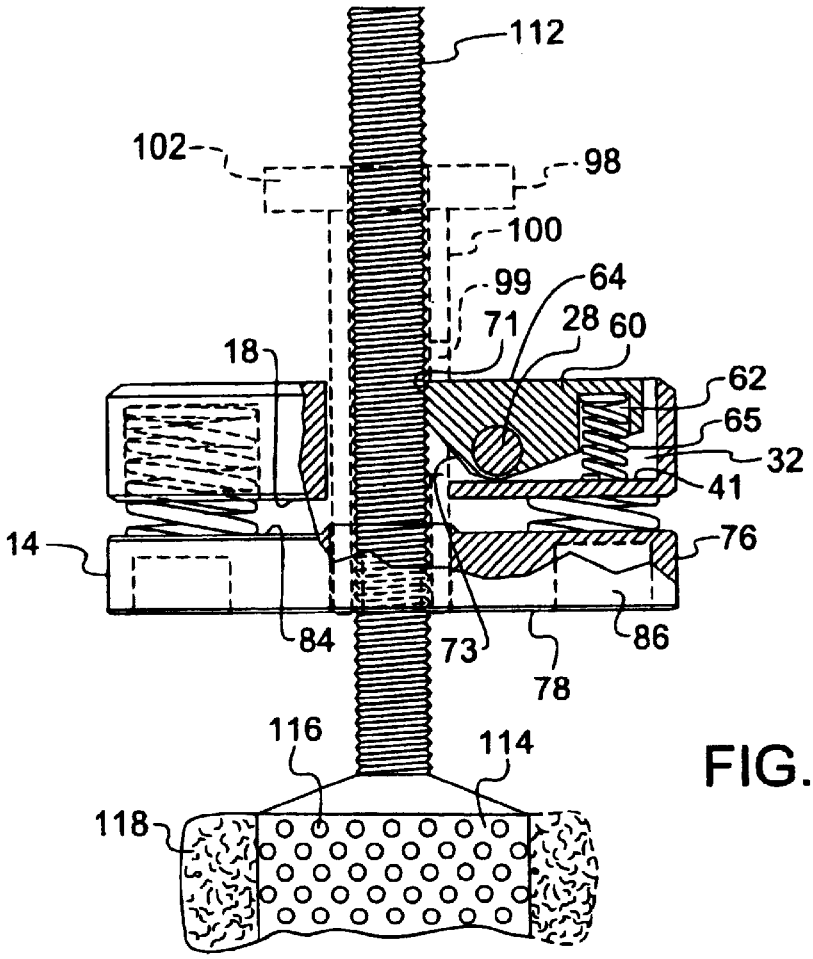
FIG. 2 is a front elevation view, in partial cross-section, of the locking assembly of FIG. 1, disposed on a threaded rod of a dye spindle on which is mounted a yarn roll.
Figure 3:
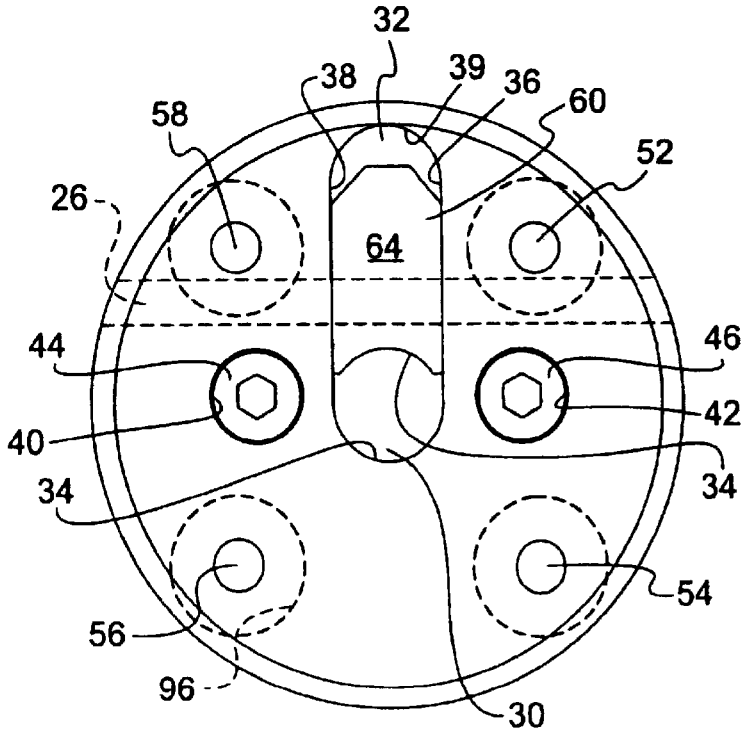
FIG. 3 is a top plan of the locking assembly of FIG. 1.

Referring now to the drawings, FIGS. 1–3 depict a locking assembly 10 according to one embodiment of the invention, as shown in exploded perspective view in FIG. 1, in front elevation, partial cross-section view in FIG. 2, as disposed on a threaded rod of a dye spindle on which is mounted a yarn roll, and in top plan view in FIG. 3.

The locking assembly 10 includes a main upper body member 12 joined to a main lower body member 14. The main upper body member 12 as shown is of a cylindrical block form with a main circular top surface 16, a main circular bottom surface 18 and a cylindrical side wall 20 which at its upper extremity may be beveled as illustrated. The side wall 20 may have a recess 24 therein, with an open end of the throughbore opening 26 in the recess accommodating insertion of the axle element 28 into the throughbore opening.

The main upper body member 12 has a central opening 30 therein for passage therethrough of a yarn roll spindle rod 112, as shown in FIG. 2. The central opening 30 communicates with a radial cavity 32 extending radially outwardly from the central opening, and bounded by parallel side walls 36 and 38, semicircular end walls 34 and 39, and recessed floor 41.

The main upper body member 12 has cylindrically-shaped spring cavities 52, 54, 56 and 58 therein, each of which is bounded by a cylindrical wall surface 96 as shown in FIG. 3. The spring cavities are shown as communicating via associated reduced diameter openings with the main circular top surface 16, such feature being optional and the main upper body member 12 being otherwise manufacturable with spring cavities that do not communicate with the main circular top surface 16.

The main upper body member 12 also has openings 40 and 42 therein. Each of these openings has a larger diameter upper portion and a smaller diameter lower portion, accommodating passage therethrough and seating therein of fixture screws 44 and 46, respectively. As shown, the fixture screws may be of allen-type for selective tightening and loosening thereof with an allen wrench of suitable size, or the screws may be of alternative type, accommodating flat-head, phillips-head or other rotary driver. Further, in place of the fixture screws, other types of mechanical fasteners, e.g., latches, snap-connectors, disconnectible fittings, compression lock-members, clamps, etc., may be advantageously employed.

The fixture screws 44 and 46 have a smooth-surfaced shank permitting them to pass through the corresponding lower portion of the openings 40 and 42, and a reduced diameter lower screw portion with threading complementary to the threading in threaded openings 48 and 50 in the lower main body member 14. In this manner, the upper main body member 12 and the lower main body member 14 are joined together, with the springs 104, 106, 108 and 110 disposed in the respective cavities 52, 54, 56, and 58, so that the respective upper and lower main body members are coupled in a manner that permits compression and expansion of these members relative to one another. Such expansion/contraction capability is desirable from the standpoint of accommodating corresponding expansion and contraction in the components of the structure, e.g., the yarn rolls on the dye spindle being locked in position by the locking assembly.

Considering the lower main body member 14 in greater detail, such member is of generally cylindrical block form, as is apparent from the drawings. The lower main body member 14 has a central opening 82 which is coaxially registered with opening 30 in the upper main body member 12 when such members are coupled with one another, so that the threaded spindle rod 112 (see FIG. 2) passes therethrough.

The lower main body member 14 has a main top surface 84 and a main bottom surface 78 that are parallel to one another, and an outer cylindrical surface 76. The bottom surface 78 as shown may optionally have an annular channel 86 therein, which permits engagement with complementary structure (not shown) for positionally fixing the lower main body member 14.

It will be recognized that the lower main body member 14 can be differently configured than is shown in the Figures. For example, the lower main body member may be devoid of any annular channel feature, and may simply be disk-shaped and of uniform thickness along its entire radial and circumferential extent.

In the arrangement shown, the lower ends of the springs 104, 106, 108 and 110 repose on the top surface 84 of the lower main body member, as shown in FIG. 2. Alternatively, the springs may be sized to repose in the annular channel 86. As a still further alternative, the lower main body member may be formed with recipient cavities for the springs, so that the springs may repose in such cavities.

Further, although the illustrative embodiment of FIGS. 1–3 has been shown with springs as the biasing elements providing the locking assembly with compressive and expansionary mobility (of the respective upper and lower main body members in relation to one another), it will be appreciated that other biasing means may be employed to equal advantage. Examples of alternative biasing means include collapsible resiliant dome elements, memory material elements, viscoelastic deformable damping material elements, compressible closed-foam material elements, etc.

By such provision of biasing means, the the upper main body member and lower main body member are resiliantly biased apart from one another to provide the locking assembly with compression/expansion capability. The biasing means may be of any suitable stiffness or resistance character. As an illustrative example, the biasing means may comprise springs that resist dyeing operation pressures of up to 80 pounds per square inch (psi), so that the locking assembly provides positional stability at the pressures encountered in use of the assembly.

The thread-locking jaw member 60 is mounted on axle element 28 extending through the throughbore opening 26 and through opening 66 in the thread-locking jaw member 60. In this manner, the thread-locking jaw member 60 is disposed in the radial cavity 32, with the parallel sides 70 and 72 of the thread-locking jaw member 60 being positioned so that they are adjacent and parallel to the side wall surfaces 36 and 38 of the radial cavity.

At a radially inner engagement face 68 of thread-locking jaw member 60 is provided an upper threaded portion 71 of the engagement face of the jaw member. The jaw member at a lower portion 73 of the engagement face is unthreaded (smooth). The thread-locking jaw member 60 on the underside of its radially outer portion is provided with a cavity 62 accommodating positioning therein of a spring 65 whose lower end is reposed on the floor 41 of the radial cavity 32 as best shown in FIG. 2. In this manner, the thread-locking jaw member 60 is biased by the spring 65 into position as shown in FIG. 2, when the locking assembly is dropped onto the dye spindle threaded rod 112, so that the upper threaded portion 71 of the engagement face of the jaw member engages the threads of the threaded rod 112.

As shown in FIG. 2, the locking assembly 10 is mounted on threaded rod 112 which extends vertically upwardly from the dye spindle 114. The dye spindle 114 has mounted thereon a roll 118 of yarn, for high pressure dyeing thereof, by expression of dye through openings 116 of the dye spindle, so that high pressure dye is forced radially outwardly through the yarn roll 118.

In the position shown in FIG. 2, the jaw member 60 is in its normal biased position with the threaded rod passing through the central bore of the locking assembly. In such position, the upper threaded portion 71 of the engagement face is in thread-locking contact with threads of the threaded rod 112. In this position, the locking assembly 10 is positionally secured on the threaded rod, and by downward pressure on the locking assembly, the locking assembly may be brought into abutment with the dye spindle 114 so as to vertically positionally secure the yarn roll 118 on the spindle.

The locking assembly 10 can subsequently be readily removed from the dye spindle threaded rod 112 by thumb or finger pressure manually exerted on the radially outer end of the top surface 64 of the thread-locking jaw member 60 to induce pivotal movement thereof, so that the thread-locking jaw member 60 pivots upwardly (i.e., in the clockwise direction in the view shown in FIG. 2) about the axle element 28, with the spring 65 being correspondingly compressed. In such manner, the locking assembly then disengages (at the upper threaded portion 71 of the engagement face of the jaw member) from the threaded rod 112 and may be lifted upwardly and off the threaded rod 112.

This pivotal translation of the jaw member thus effects a "quick release" of the locking assembly, as the unthreaded lower portion 73 of the engagement face of the jaw member is translated into contact with the threads of the threaded rod 54. With the unthreaded, smooth-surfaced lower portion 73 of the jaw member in contact with the threads of threaded rod, the locking assembly can readily be slid past the threads of the threaded rod with upward lifting of the locking assembly, e.g., by manual or machine gripping of the locking assembly.

In lieu of the spring 65 used in the illustrative embodiment described hereinabove, any other types of biasing element can be employed, e.g., biasing elements of the types discussed hereinabove in connection with the description of alternative biasing elements that may be used in place of the springs 104, 106, 108 and 110, for the same functional purpose.

The locking assembly optionally may be provided with a collar member 98 including a tubular element 100 journaled in the central opening 32 of the upper main body member, or otherwise joined to the upper main body member, with a cut-out 99 in the tubular element to accommodate engagement of the threaded upper portion 71 of the jaw member with the threaded rod 112 and pivotal movement of the jaw member upon manual pressure exerted on a radially outer part of the jaw member. The collar member may have a radially outwardly extending flange 102 at its upper end, joined to the tubular element, e.g., by welding, brazing, soldering, adhesive bonding, ultrasonic bonding, etc. The collar member thus provides a means for facilitating the manually grasping of the locking assembly for purposes of transport of same, installation on the threaded rod 112 and removal of the locking assembly from the threaded rod.

The collar member may as illustrated pass through the central openings of both the upper and lower main body members, while being secured to only the upper main body member so that the tubular element 100 is freely slidable in the vertical direction in the central opening of the lower main body member. Alternatively, the tubular element 100 may simply extend from the flange 102 to the upper surface of the upper main body member, and be secured to the upper surface so as to circumscribe the central opening of the upper main body member at such location.

The collar member is an optional feature and may be unnecessary in many instances, depending on the dimensional character and "handleability" characteristics of the locking assembly. For example, in one embodiment, the locking assembly has a diameter of about 8.2 centimeters, and a height (with the upper and lower main body members coupled to one another) of about 3.5 centimeters, which renders it of a conveniently hand-held character during installation and removal.

When installing the locking assembly on the threaded rod 112, the bore of the locking assembly may be slid over the top end of the threaded rod 112 and then "dropped" onto the rod, so that the weight of the locking assembly causes it to slide downwardly over the threaded rod to effect a "ratcheting down" translation of the upper threaded portion 71 of the jaw member so that the locking assembly is downward translated over the threads of the threaded rod 112 to a final, locked "down" stop position.

When the locking assembly is locked down against the dye spindle 114, high pressure dye may unavoidably enter the bore of the locking assembly. The locking assembly may therefore be equipped with one or more drainage holes, ports or other structure for effecting draining of the liquid from the locking assembly.

Thus, when the locking assembly is positioned on the threaded rod of the dye spindle in the position to be secured, the upward biasing action of the biasing element 65 (see FIG. 2) will cause the jaw member to engage the threads of the rod 112 in a thread-locked position. In this manner, the locking assembly will positionally secure the dye spindle and yarn roll in relation to one another, so that dying of the yarn in the roll can proceed by high pressure force-out of the dye, through the dye spindle and holes in the surface thereof, to the yarn circumscribing the dye spindle.

It will be recognized that the main body members of the locking assembly of the present invention may be variously configured and may be arranged in a variety of conformations other than the cylindrical forms shown and described herein. For example, the main body members may be of square cross-section, octagonal or polygonal cross-section, or other cross-sectional shape, as may be desired or appropriate in a given end use application of the invention. Nonetheless, the circular cylindrical form shown is preferred in practice, and is particularly useful for manual grasping and positioning of the locking assembly on a threaded rod of a dye spindle.

Although the invention has been illustratively described herein in reference to various features, aspects and embodiments, it will be recognized that the form, construction and operation of the liquid delivery vaporization and vapor deposition system may be widely varied in the broad practice of the present invention, and that variations, modifications and other embodiments are contemplated, within the spirit and scope of the invention as herein disclosed.

What is claimed is:

1. A locking assembly useful for lockingly engaging a threaded rod, said assembly comprising:

an upper main body member having a central bore therethrough, a cavity, and a transverse bore, the cavity communicating with and extending radially outward from said central bore, the cavity having a floor therein, and the transverse bore extending through the main body and communicating with said cavity above said floor;

a biasing element disposed in said cavity and extending upwardly from the floor of said cavity;

a pivot pin mounted in the transverse bore; and a jaw member supported by the pivot pin, the jaw member having an outer portion and an inner engagement face, the outer portion having a top surface and a bottom surface coupled with the biasing element, the engagement face having an upper threaded portion and a lower smooth portion;

a lower main body member having a central bore therethrough;

means for coupling the upper main body member and the lower main body member with one another so that the upper main body member and lower main body member are resiliantly biased apart from one another to provide the locking assembly with compression/expansion capability.

2. The locking assembly of claim 1, wherein the means for coupling the upper main body member and the lower main body member with one another comprise resilient biasing means.

3. The locking assembly of claim 2, wherein the resilient biasing means comprise springs.

4. The locking assembly of claim 1, wherein the means for coupling the upper main body member and the lower main body member with one another comprise mechanical fasteners.

5. The locking assembly of claim 4, wherein the mechanical fasteners comprise screws.

6. The locking assembly of claim 1, wherein the means for coupling the upper main body member and the lower main body member with one another comprise mechanical fasteners and resilient biasing means.

7. The locking assembly of claim 1, wherein the means for coupling the upper main body member and the lower main body member with one another comprise springs and screws.

8. The locking assembly of claim 1, wherein the upper main body member and the lower main body member are each cylindrical in shape.

9. The locking assembly of claim 1, wherein said cavity has a racetrack shape.

10. The locking assembly of claim 1, further comprising a collar member joined to the locking assembly, to facilitate manual grasping thereof.

11. A yarn dyeing apparatus, comprising:

a yarn dyeing spindle assembly, including an upwardly extending threaded rod;

a locking assembly lockingly engaging said threaded rod, said assembly comprising:

an upper main body member having a central bore therethrough, a cavity, and a transverse bore, the cavity communicating with and extending radially outward from said central bore, the cavity having a floor therein, and the transverse bore extending through the main body and communicating with said cavity above said floor;

a biasing element disposed in said cavity and extending upwardly from the floor of said cavity;

a pivot pin mounted in the transverse bore; and a jaw member supported by the pivot pin, the jaw member having an outer portion and an inner engagement face, the outer portion having a top surface and a bottom surface coupled with the biasing element, the engagement face having an upper threaded portion and a lower smooth portion;

a lower main body member having a central bore therethrough;

means for coupling the upper main body member and the lower main body member with one another so that the upper main body member and lower main body member are resiliantly biased apart from one another to provide the locking assembly with compression/expansion capability;

wherein the threaded rod extends through the central bore in each of said upper main body member and said lower main body member, and the upper threaded portion of the engagement face of the jaw member is threadably engaged with threading on the threaded rod.

12. The yarn dyeing apparatus of claim 11, wherein the means for coupling the upper main body member and the lower main body member with one another comprise resilient biasing means.

13. The yarn dyeing apparatus of claim 12, wherein the resilient biasing means comprise springs.

14. The yarn dyeing apparatus of claim 11, wherein the means for coupling the upper main body member and the lower main body member with one another comprise mechanical fasteners.

15. The yarn dyeing apparatus of claim 14, wherein the mechanical fasteners comprise screws.

16. The yarn dyeing apparatus of claim 11, wherein the means for coupling the upper main body member and the lower main body member with one another comprise mechanical fasteners and resilient biasing means.

17. The yarn dyeing apparatus of claim 11, wherein the means for coupling the upper main body member and the lower main body member with one another comprise springs and screws.

18. The yarn dyeing apparatus of claim 11, wherein the upper main body member and the lower main body member are each cylindrical in shape.

19. The yarn dyeing apparatus of claim 11, wherein said cavity has a racetrack shape.

20. A locking assembly comprising upper and lower body members coupled to one another so that the upper body member and lower body member are resiliantly biased apart from one another to provide the locking assembly with compression/expansion capability, with a central opening in each of the upper and lower body members, in registration with one another, and with a pivotable jaw member mounted on the upper body member biased to a locking position and manually pivotable to a released position, said jaw member extending radially from (a) an inner portion, including a locking face constructed to lockingly engage a spindle passing through said central opening, in said locking position, to (b) an outer portion, said jaw member being manually pivotable to said release position by manual exertion of downward pressure on said outer portion.

21. A yarn roll spindle locking assembly, comprising upper and lower body members each having a central opening therein to accommodate passage through the central opening of a spindle when the upper and lower body members are coaxially aligned with one another, the upper and lower body members being resiliently biased apart by compressible biasing elements mounted therebetween, said upper body member having a radial cavity therein extending radially outwardly from said central opening, with a jaw member pivotally mounted in the cavity, and biased to a locking position by a compressible biasing element in said cavity, and said pivotable jaw member being manually pivotable to a release position to disengage the locking assembly from said spindle, by exertion of manual pressure on a radially outer portion of the pivotable jaw member.

22. The yarn roll spindle locking assembly of claim 21, wherein the upper and lower body members have a generally cylindrical form.

* * * * *